US005174555A

United States Patent [19]

Lossing

[11] Patent Number: 5,174,555

[45] Date of Patent: Dec. 29, 1992

[54] VERSATILE TOOL MOUNTING ASSEMBLY

[76] Inventor: Neil D. Lossing, 7200 Cahill Rd., Edina, Minn. 55439

[21] Appl. No.: 828,250

[22] Filed: Jan. 30, 1992

[51] Int. Cl.[5] ..... B25H 1/10

[52] U.S. Cl. ..... 269/71; 269/82

[58] Field of Search ..... 269/45, 71, 81, 82-85, 269/99, 100, 203; 144/285, 286 R, 287, 286 A

[56] References Cited

U.S. PATENT DOCUMENTS

| | | | |
|---|---|---|---|
| 568,543 | 9/1896 | Parks | 269/45 |
| 1,600,835 | 9/1926 | Manley | 269/82 |
| 2,458,370 | 1/1949 | Geddes | 269/45 |
| 2,649,819 | 8/1953 | Hussey | 269/82 |
| 2,896,681 | 7/1959 | Olsen . | |
| 2,969,231 | 1/1961 | Mills | 269/84 |
| 2,969,817 | 1/1961 | Zabich . | |
| 3,123,353 | 3/1964 | Schulze et al. | 269/82 |
| 3,592,460 | 7/1971 | Lower . | |
| 4,575,061 | 3/1986 | Dille | 269/45 |
| 4,779,857 | 10/1988 | Mound | 269/71 |
| 4,848,758 | 7/1989 | Mills . | |

*Primary Examiner*—Robert C. Watson
*Attorney, Agent, or Firm*—John R. Flanagan

[57] ABSTRACT

A versatile tool mounting assembly includes an elongated rail and a fixture mounted to the rail and capable of mounting a tool. The rail includes a pair of longitudinal channels and a pair of end braces rigidly attached to opposite ends of the channels. The end braces fixedly dispose the channels in laterally spaced relation to one another so as to define an open longitudinal passage extending between the end braces. The fixture is mounted to the longitudinal passage of the rail for sliding movement to any desired position along the rail and for rotational movement to any desired 360° angular position about an axis extending transverse to the longitudinal passage of the rail. The fixture includes a platform disposed at the exterior of the rail and capable of mounting a tool, a shaft attached to the platform and extending through the longitudinal passage of the rail, and a fastener removably attachable to an opposite end of the shaft to releasably secure the fixture to the rail at the desired position therealong and at the desired 360° angular position relative thereto. The assembly also includes a pair of shafts mounted to the opposite end braces of the rail and extending in opposite directions outwardly therefrom for rotatably mounting the rail between a pair of upright supports, and fasteners being removably secured to the shafts for securing the rail between the supports.

18 Claims, 4 Drawing Sheets

VERSATILE TOOL MOUNTING ASSEMBLY

BACKGROUND OF THE INVENTION

1. Field of the Invention

The present invention generally relates to tool mounting arrangements and, more particularly, is concerned with a versatile tool mounting assembly.

2. Description of the Prior Art

Tool, such as clamps, vises, etc., are widely employed for holding workpieces stationary in order to perform operations, such as drilling, grinding, sawing, sanding, etc., on the workpieces. Heretofore, these tools have ordinarily had to be mounted on work benches which restricted the places where the tools could be used to assist in carrying out the aforementioned operations on the workpieces.

It would be highly desirable to be able to take the tools to the wide variety of places or sites where the tools are needed to hold workpieces. However, use of heavy and bulky work benches to mount the tools have made it difficult to fulfill this desire.

Consequently, a need exists for improvement of the means by which tools for holding workpieces are mounted in order to increase the range of locations and positions at which the tools can be used.

SUMMARY OF THE INVENTION

The present invention provides a versatile tool mounting assembly designed to satisfy the aforementioned needs. The tool mounting assembly of the present invention is adapted to support any one of a variety of different conventional tools. Also, the tool mounting assembly is portable so that it can be moved to many different sites where users may desired to setup tools. Further, the tool mounting assembly is adapted to permit moving the tool to any desired stationary position along a longitudinal axis of the mounting assembly and rotating the tool through 360° to any desired angular position about the longitudinal axis and also about another axis of the mounting assembly extending in orthogonal relation to the longitudinal axis.

Accordingly, the present invention is directed to a versatile tool mounting asssembly which comprises: (a) an elongated rigid member having a pair of opposite ends; and (b) a tool-mounting fixture mounted for movement along the elongated rigid member between its opposite ends. The rigid member defines a longitudinal axis and a pair of opposite longitudinal portions extending between its opposite ends and generally parallel to the longitudinal axis. The opposite longitudinal portions of the rigid member together define an open longitudinal passage extending between the opposite ends of the rigid member and generally parallel to the longitudinal axis.

The tool-mounting fixture includes an upper member, an intermediate member and a lower member. The upper member is a platform disposed at the exterior of one longitudinal portion of the rigid member and being capable of mounting a tool. The intermediate member is an elongated shaft rigidly attached at one end to the platform and extending therefrom in transverse relation to the platform and the rigid member through the open longitudinal passage thereof. The elongated shaft and the platform therewith is capable of rotational movement relative to the rigid member about an axis defined by the shaft and of sliding movement relative the rigid member along the open longitudinal passage and in the direction of the longitudinal axis. The lower member is a fastener removably attachable to an opposite end of the elongated shaft extending from the longitudinal passage of the rigid member for clamping the platform and fastener respectively against the opposite longitudinal portions of the rigid member. The fastener can releasably secure the tool-mounting platform to the rigid member at any desired position therealong and at any desired 360° angular position relative thereto.

Further, the rigid member is an elongated rail formed by a pair of elongated channels and a pair of end braces rigidly attached to respective opposite ends of the channels and fixedly disposing the channels in laterally spaced relation to one another such that the channels together define the open longitudinal passage extending between the opposite ends of the rigid member. Also, the tool-mounting platform includes a flat plate and a collar rigidly attached to an underside of the plate and having a central opening. The one end of the shaft is seated through the opening of the collar and at the center of the plate where it is rigidly attached to the underside of the plate.

The tool mounting assembly also comprises a pair of upright supports and means attachable to the opposite ends of the elongated rigid member for mounting the rigid member to the upright supports. The mounting means includes a pair of shafts mounted to the opposite ends of the rigid member and extending coaxially with the longitudinal axis of the rigid member. The shafts rotatably mount the rigid member between the upright supports. The mounting means also includes a pair of fasteners removably secured to respective outer ends of the shafts for retaining the shafts mounted to the upright supports and tightly securing the rail thereto at any desired 360° angular position about the longitudinal axis.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
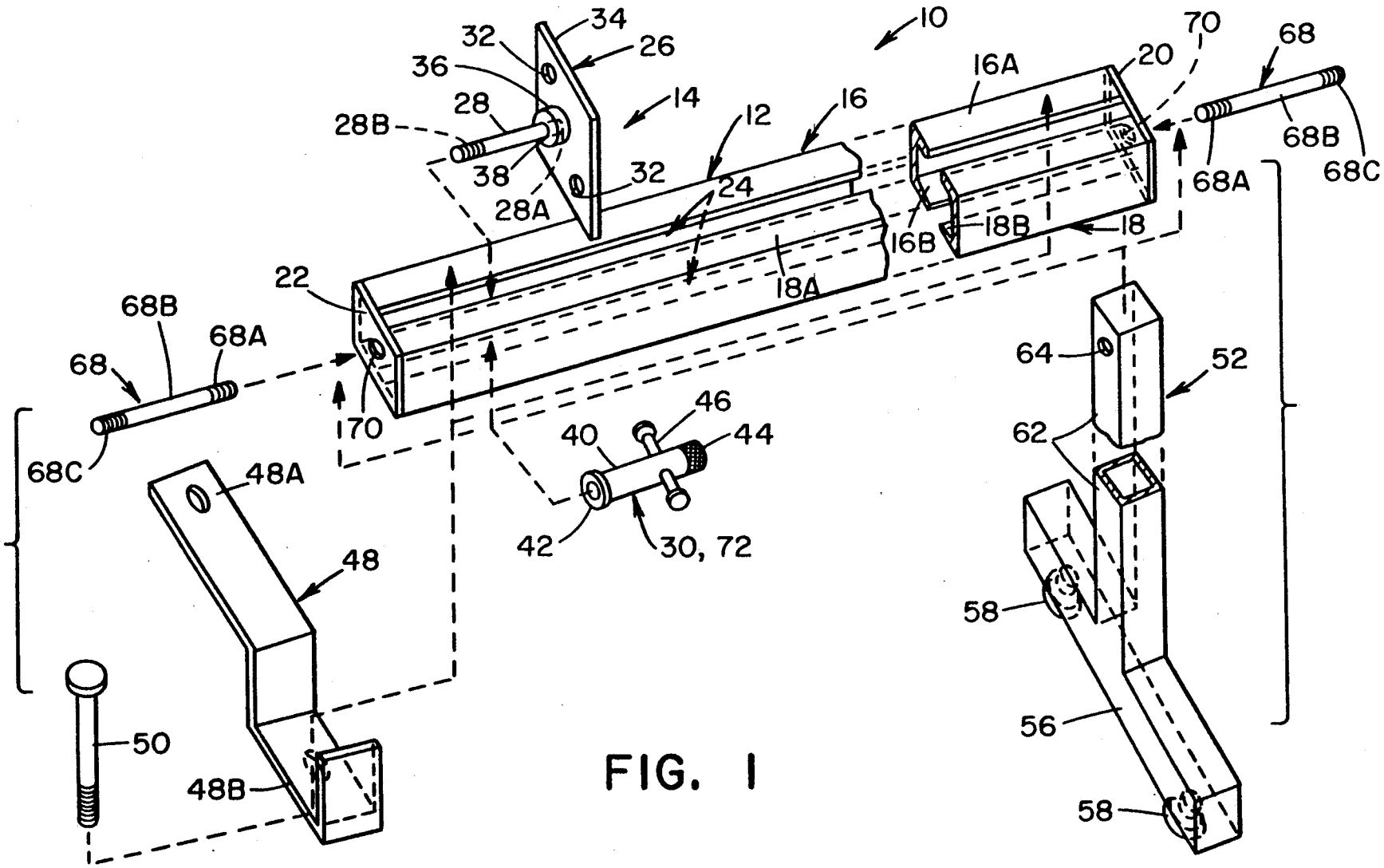
FIG. 1 is an exploded perspective of a versatile tool mounting assembly in accordance with the present invention.
Figure 2:
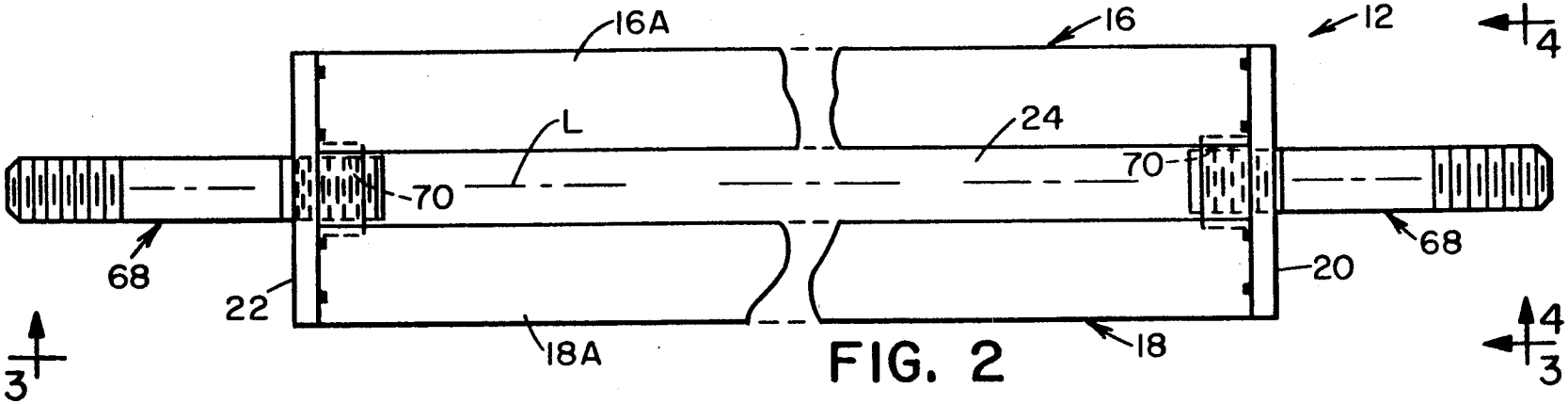
FIG. 2 is an enlarged foreshortened top plan view of an elongated mounting rail of the tool mounting assembly of FIG. 1.
Figure 3:
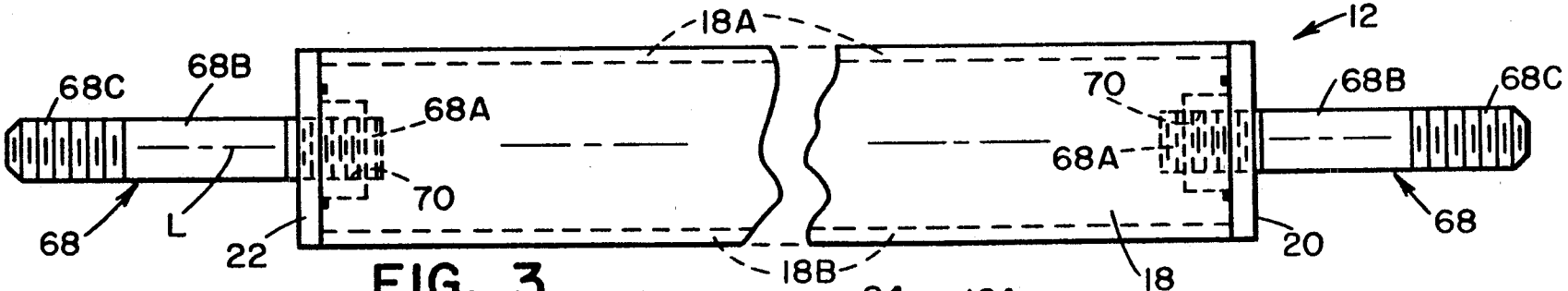
FIG. 3 is a side elevational view of the mounting rail as seen along line 3—3 of FIG. 2.
Figure 4:
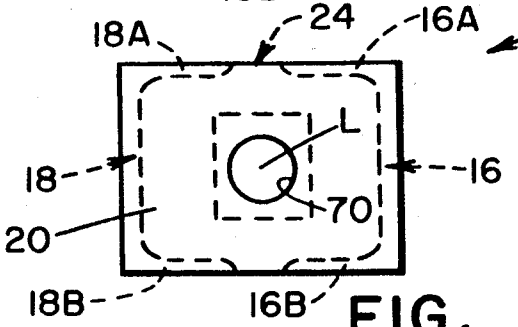
FIG. 4 is an end elevational view of the mounting rail as seen along line 4—4 of FIG. 3.

Referring to the drawings and particularly to FIG. 1, there is illustrated a tool mounting assembly, generally designated 10, in accordance with the present invention. The tool mounting assembly 10 basically includes an elongated rigid member or rail 12 and a tool-mounting fixture 14 mounted to the rail 12 for movement between its opposite ends.

Referring to FIGS. 1–6, the elongated rail 12 of the assembly 10 is formed by a pair of elongated rigid channels 16, 18 and a pair of flat plate-like end braces 20, 22 rigidly attached to respective opposite ends of the channels 16, 18. The channels 16, 18 each has a U-shaped cross-section and are aligned so that one channel is a mirror image of the other channel. The opposite ends of the channels defining opposite open ends on the rail. The flat end braces are fixedly attached on the opposite ends of the channels so as to close the opposite open ends on the rail. The end braces 20, 22 fixedly dispose the channels 16, 18 in laterally spaced relation to one another such that opposite longitudinal portions 16A, 16B and 18A, 18B thereof define an open longitudinal slot or passage 24 extending between the end braces 20, 22 of the rail 12 and opening at the opposite upper and lower sides thereof.

Figure 5:
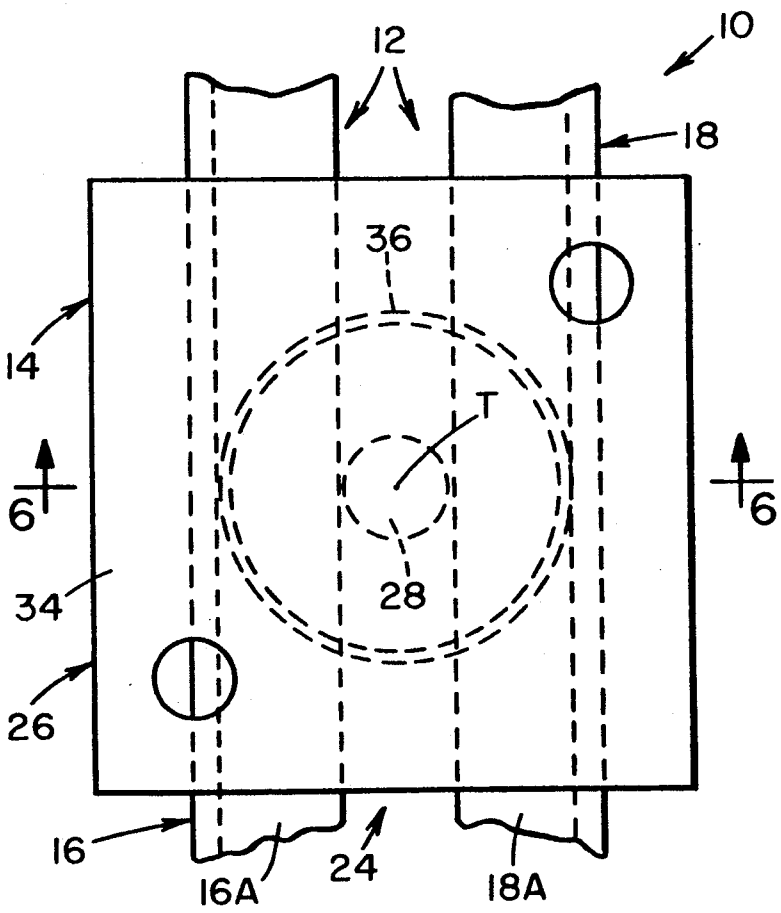
FIG. 5 is an enlarged fragmentary top plan view of the tool mounting assembly showing a tool mounting platform on the mounting rail of the tool mounting assembly.
Figure 6:
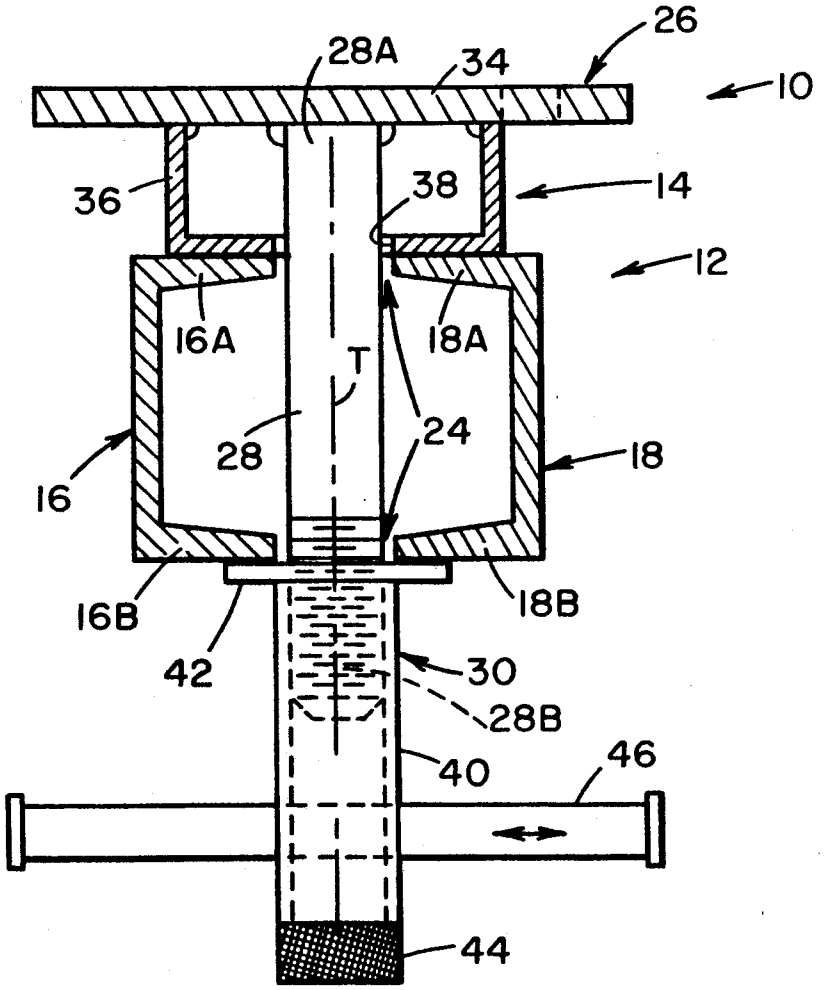
FIG. 6 is a cross-sectional view of the tool mounting assembly taken along line 6—6 of FIG. 5.
Figure 8:
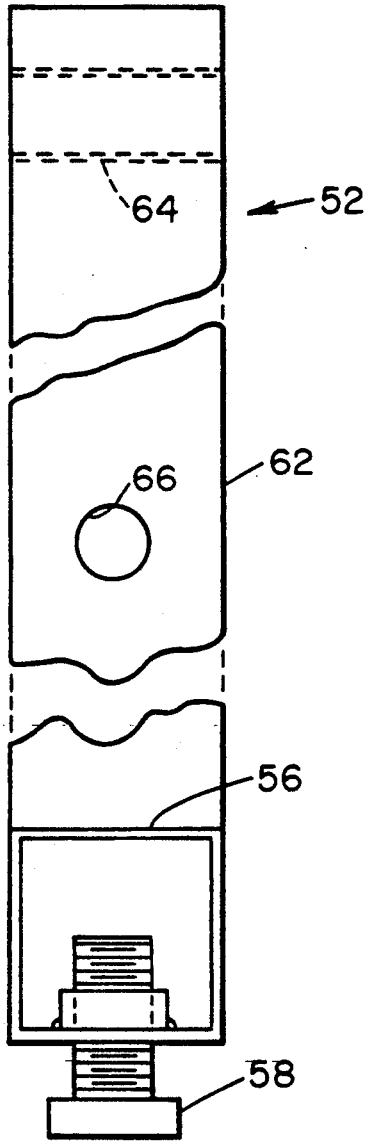
FIG. 8 is a side elevational view of the upright support as seen along line 8—8 of FIG. 7.
Figure 7:
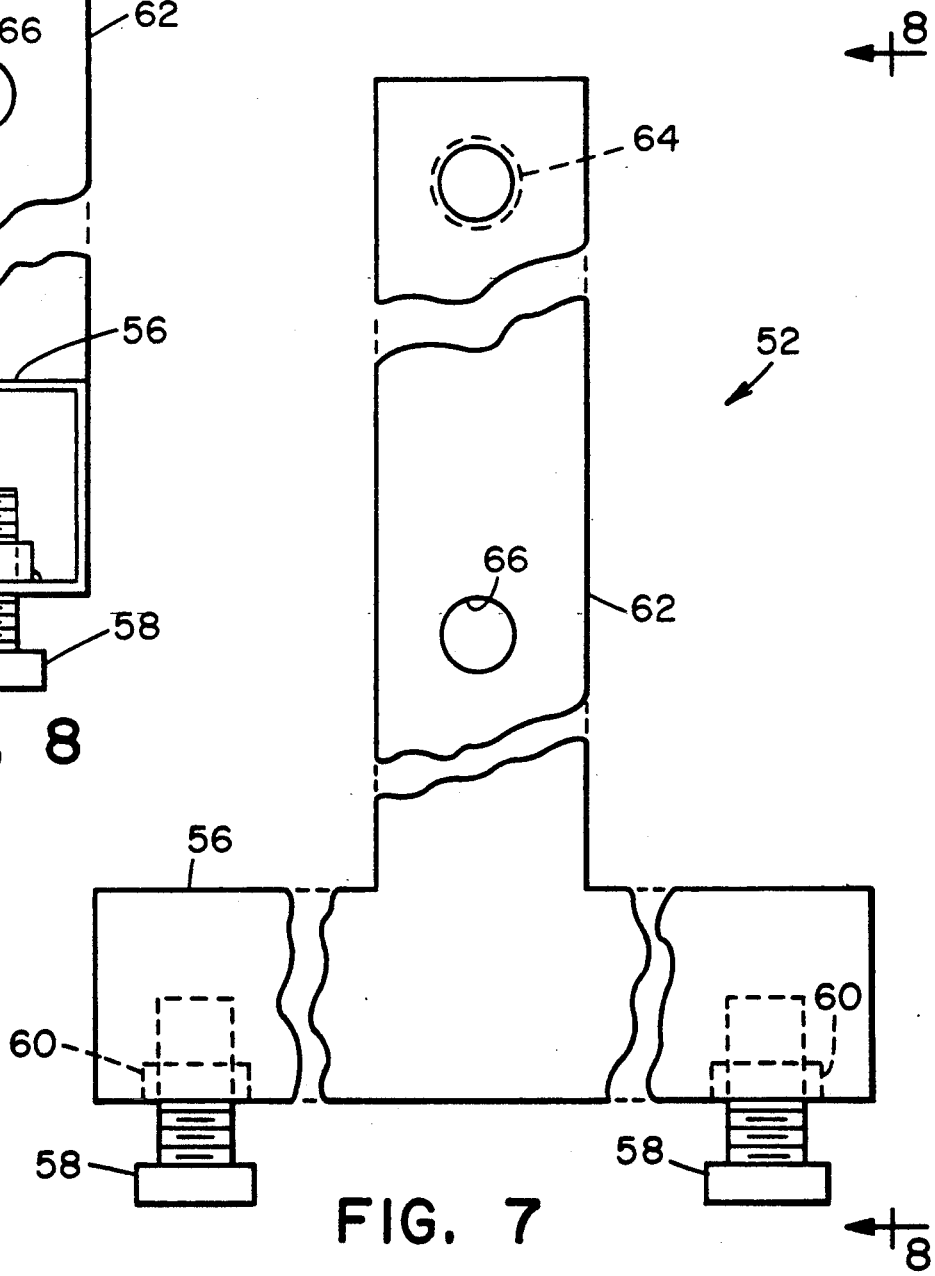
FIG. 7 is an enlarged foreshortened end elevational view of an upright support of the tool mounting assembly.

Referring to FIGS. 1, 5 and 6, the tool-mounting fixture 14 of the assembly 10 includes an upper member in the form of a platform 26 for holding a tool, an intermediate member in the form of an elongated shaft 28, and a lower member in the form of a fastener 30. The platform 26 of the fixture 14 is disposed at the exterior of the upper longitudinal portions 16A, 18A of the channels 16, 18 of the elongated rail 12. The platform 26 has a plurality of spaced holes 32 defined adjacent its corners for receiving a plurality of fasteners (not shown) to attach the particular tool to the platform 26.

The elongated cylindrical shaft 28 of the fixture 14 is attached at one end 28A to the underside of the platform 26. The shaft 28 extends through the open longitudinal passage 24 of the rail 12 in transverse relation to the platform 26 and the longitudinal passage 24. The shaft 28 defines a transverse axis T about which the shaft 28 and the platform 26 therewith are capable of being rotated manually relative to the rail 12 to preset the fixture 14 at any desired 360° angular position about the transverse axis T relative to the rail 12. The shaft 28 and the platform 26 therewith also are capable of being slid manually along the longitudinal passage 24 to any desired position along the rail 12.

More particularly, the platform 26 includes a flat rectangular plate 34 and a circular collar 36 rigidly attached to the underside of the flat plate 34 and having a central opening 38. The one end 28A of the elongated shaft 28 seats through the opening 38 of the collar 36 to the center of the plate 34 where it is rigidly attached to the underside of the plate 34.

The fastener 30 of the fixture 14 is removably attachable to an externally-threaded opposite end 28B of the elongated shaft 28 extending from the longitudinal passage 24 of the rail 12 in order to releasably secure the tool-mounting fixture 14 to the elongated rail 12 at any desired position therealong and at any desired 360° rotational position about the transverse axis T. When the fastener 30 is tightened on the shaft end 28B, the platform 26 and fastener 30 are clamped respectively against the opposite longitudinal portions 16A, 18A and 16B, 18B of the channels 16, 18 of the rail 12 so as to retain the fixture 14 at the desired position. The fastener 30 can take any suitable form. Preferably, the fastener 30 is a long hex nut 40 having a stop washer 42 rigidly attached at one end, a knurled surface 44 defined at an opposite end and a transverse rod 46 slidably mounted through the hex nut 40 adjacent to the knurled end to use in rotating the fastener 30.

Referring to FIG. 1, the tool mounting assembly 10 can also include a pair of brackets 48 for supporting the rail 12 from an edge of a work bench, pickup truck tail gate or similar support structure. Each bracket 48 can be attached at one end 48A to the support structure by suitable fasteners (not shown), such as conventional bolts. Each bracket 48 has a U-shaped opposite end 48B for holding the rail 12 and receiving a fastener 50 inserted transversely through the longitudinal passage 24 of the rail.

Referring to FIGS. 1–4, 7 and 8, alternatively, the tool mounting assembly 10 can include a pair of upright supports 52 and means 54 attachable to the end braces 20, 22 at the opposite ends of the elongated rail 12 for mounting the rail between the upright supports 52. Each upright support 52 has an inverted T-shaped configuration, being formed by a horizontal base beam 56 supported on adjustable leveling feet 58 threaded into a nut 60 rigidly attached to its opposite ends and an upright beam 62 rigidly mounted at the middle of the base beam 56. The upright beam 62 has a hollow sleeve 64 rigidly mounted across an upper portion thereof. Other holes 66 (only one shown) can be provided through the beam 62 for use in storing tools.

The mounting means 54 includes a pair of studs or shafts 68 threadably mounted at inner ends 68A through threaded holes 70 formed in the end braces 20, 22 on the opposite ends of the rail 12. The shafts 68 together define a longitudinal axis L of the rail 12 which extends parallel to the open longitudinal passage 24. The shafts 68 have smooth middle portions 68B which rotatably mount through the sleeves 64 and, in turn, rotatably mount the rail 12 between the upright supports 52. The mounting means 54 also includes a pair of fasteners 72, preferably identical to earlier-described fasteners 30. The fasteners 72 are removably secured to respective threaded outer ends 68C of the shafts 68 for retaining the shafts mounted to the upright supports 52 and tightly securing the rail 12 thereto after being rotated to any desired 360° angular position about the longitudinal axis L.

Any one of a variety of conventional tools can be mounted on the platform 26 of the tool-mounting fixture 14. The following are some of the tools that can be secured to the fixture: drill stand, machinist vise, pipe vise, work surface, bench grinder, work light, vise grips, miter box, saber saw, router, anvil, conduit bender, drawing board, cord reel, pipe clamps and C clamps.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A versatile tool mounting assembly, comprising:

(a) an elongated rigid rail including a pair of rigid longitudinal channels having a pair of opposite ends defining opposite open ends on said rail and a pair of opposite longitudinal portions extending between said opposite ends of said channels, said rail also including a pair of rigid flat end braces fixedly attached on said respective opposite ends of said channels so as to close said opposite open ends on said rail and fixedly dispose said channels in laterally spaced relation to one another such that said spaced channels define an open longitudinal passage extending between said opposite longitudinal portions of said channels and said opposite end braces; and (b) a fixture capable of mounting a tool and being mounted to said opposite longitudinal portions of channels of said rail through said longitudinal passage for sliding movement to any desired position along said channels and between said end braces and for rotational movement to any desired 360° angular position about an axis extending transverse to said longitudinal passage of said rigid rail.

2. The assembly of claim 1 wherein each of said channels has a U-shaped cross-section, one channel being aligned in reverse relation to the other channel.

3. The assembly of claim 1 wherein said fixture includes:

an upper member disposed at the exterior of one of said longitudinal portions of said channels of said rail and being capable of mounting the tool;

an intermediate member attached to said upper member and extending therefrom in transverse relation to said rail through said open longitudinal passage of said rail, said intermediate member and said upper member therewith being capable of rotational movement relative to said rail about said transverse axis defined by said intermediate member and of sliding movement along said rail; and a lower member removably attachable to said intermediate member in order to releasably secure said fixture to said rail at said any desired position therealong and at said any desired 360° angular position about said transverse axis relative to said rail.

4. The assembly of claim 3 wherein said upper member of said fixture is a platform having means for attaching the toll thereon.

5. The assembly of claim 4 wherein said intermediate member is an elongated shaft rigidly attached at one end to an underside of said platform and extending therefrom in transverse relation to said platform and defining said transverse axis.

6. The assembly of claim 5 wherein said lower member is a fastener removably attachable to an opposite end of said elongated shaft extending from said open longitudinal passage of said rail for clamping said platform and fastener respectively against said opposite longitudinal portions of said channels of said rail.

7. The assembly of claim 5 wherein said platform includes a flat plate and a collar rigidly attached to said underside of said plate and having a central opening.

8. The assembly of claim 7 wherein said one end of said elongated shaft is seated through said opening of said collar at a center of said plate where it is rigidly attached to said underside of said plate.

9. The assembly of claim 1 further comprising:

(c) means attachable to said opposite end braces of said elongated rail for mounting said rail to a support structure.

10. A versatile tool mounting assembly, comprising:

(a) an elongated rigid rail including a pair of rigid longitudinal channels having a pair of opposite ends defining opposite open ends on said rail and a pair of opposite longitudinal portions extending between said opposite ends of said channels, said rail also including a pair or rigid flat end braces fixedly attached on said respective opposite ends of said channels so as to close said opposite open ends on said rail and fixedly dispose said channels in laterally spaced relation to one another such that said spaced channels define an open longitudinal passage extending between said opposite longitudinal portions of said channels and said opposite end braces; and (b) a fixture capable of mounting a tool and being mounted to said opposite longitudinal portions of said channels of said rail through said longitudinal passage for sliding movement to any desired position along said channels and between said end braces and for rotational movement to any desired 360° angular position about an axis extending transverse to said longitudinal passage of said rigid rail;

(c) a pair of upright supports; and (d) means attachable to said opposite end braces of the elongated rigid rail for mounting said rail between said upright supports.

11. The assembly of claim 10 wherein said mounting means includes:

a pair of shafts threadably mounted through a pair of threaded holes defined in said opposite end braces of said rail so as to define a longitudinal axis on said rail extending generally parallel to said open longitudinal passage thereof, said shafts mounting said rail between said upright supports for rotation about said longitudinal axis; and a pair of fasteners removably secured to outer ends of said shafts for retaining said rail mounted to said upright supports and tightly securing said rail thereto at any desired 360° angular position about said longitudinal axis defined by said shafts.

12. The assembly of claim 10 wherein said fixture includes:

an upper member disposed at the exterior of one of said longitudinal portions of said channels of said rail and being capable of mounting the tool;

an intermediate member attached to said upper member and extending therefrom in transverse relation to said rail through said open longitudinal passage of said rail, said intermediate member and said upper member therewith being capable of rotational movement relative to said rail about said transverse axis defined by said intermediate member and of sliding movement along said rail; and a lower member removably attachable to said intermediate member in order to releasably secure said fixture to said rail at said any desired position therealong and at said any desired 360° angular position about said transverse axis relative to said rail.

13. The assembly of claim 12 wherein said upper member of said fixture is a platform having means for attaching the tool thereon.

14. The assembly of claim 13 wherein said intermediate member is an elongated shaft rigidly attached at one end to an underside of said platform and extending therefrom in transverse relation to said platform and defining said transverse axis.

15. The assembly of claim 14 wherein said lower member is a fastener removably attachable to an opposite end of said elongated shaft extending from said open longitudinal passage of said rail for clamping said platform and fastener respectively against said opposite longitudinal portions of said channels of said rail.

16. The assembly of claim 14 wherein said platform includes a flat plate and a collar rigidly attached to said underside of said plate and having a central opening.

17. The assembly of claim 16 wherein said one end of said elongated shaft is seated through said opening of said collar at a center of said plate where it is rigidly attached to said underside of said plate.

18. A versatile tool mounting assembly, comprising:

(a) an elongated rigid rail including a pair of rigid longitudinal channels having a pair of opposite ends defining opposite open ends on said rail and a pair of opposite longitudinal portions extending between said opposite ends of said channels, said rail also including a pair of rigid flat end braces fixedly attached on said respective opposite ends of said channels so as to close said opposite open ends on said rail and fixedly dispose said channels in laterally spaced relation to one another such that said spaced channels define an open longitudinal passage extending between said opposite longitudinal portions of said channels and said opposite end braces; and (b) a fixture capable of mounting a tool and being mounted to said said opposite longitudinal portions of said channels of said rail through said longitudinal passage for sliding movement to any desired position along said channels and between said end braces and for rotational movement to any desired 360° angular position about an axis extending transverse to said longitudinal passage of said rigid rail;

(c) said opposite end braces respectively having a pair of threaded holes formed therethrough so as to define a longitudinal axis of rotation for said rail extending generally parallel to said open longitudinal passage of said rail; and (d) said fixture including (i) a platform disposed at the exterior of one of said longitudinal portions of said channels of said rail and being capable of mounting the tool, (ii) an elongated shaft attached to an underside of said platform and extending therefrom in transverse relation to said rail through said open longitudinal passage thereof, said shaft and said platform therewith being rotatable relative to said rail about said transverse axis being defined by said shaft and of sliding movement along said longitudinal passage of said rail, and (iii) a fastener removably attachable to an opposite end of said shaft extending from said open longitudinal passage of said rail for releasably clamping said platform and fastener respectively against said opposite longitudinal portions of said channels of said rail to thereby releasably secure said fixture to said rail at said any desired position therealong and at said any desired 360° angular position about said transverse axis.

* * * * *